US005706968A

United States Patent [19]

Riley

[11] Patent Number: 5,706,968

[45] Date of Patent: Jan. 13, 1998

[54] SAFETY CLASP ASSEMBLY FOR COVERED CONTAINERS

[75] Inventor: Edward D. Riley, Falmouth, Me.

[73] Assignee: Riley Medical, Inc., Auburn, Me.

[21] Appl. No.: 700,886

[22] Filed: Aug. 21, 1996

[51] Int. Cl.[6] ..... B65D 43/08

[52] U.S. Cl. ..... 220/326; 292/145; 292/153

[58] Field of Search ..... 220/326; 292/153, 292/145

[56] References Cited

U.S. PATENT DOCUMENTS

| | | | |
|---|---|---|---|
| 1,420,391 | 6/1922 | Sweet | 220/326 |
| 1,773,693 | 8/1930 | Stirrup | 220/326 |
| 2,945,718 | 7/1960 | Smith | 220/326 |
| 3,137,408 | 6/1964 | Taylor | 220/326 |
| 4,501,378 | 2/1985 | Berfield | 220/326 |
| 4,589,567 | 5/1986 | Pircher | 220/326 |

OTHER PUBLICATIONS

User's Manual for the MultiPak System, Copyrighted by Riley Medical, Inc., 1995, pp. 1–21, see p. 5.

*Primary Examiner*—Stephen P. Garbe

*Attorney, Agent, or Firm*—Cesari and McKenna, LLP

[57] ABSTRACT

A safety clasp for locking a cover to a container includes a rocker and an axle pivotally connecting the rocker to the cover. A slider is positioned between the axle and the cover and is slidable along the cover in a direction generally perpendicular to the axle between a locked position wherein a portion of the slider interfits with the container and an unlocked position wherein the slider portion is disengaged from the container. The slider has a projection extending away from the cover and the rocker is moveable about the axle between a first position wherein a portion of the rocker engages behind the projection when the slider is in its locked position thereby preventing the slider from moving to its unlocked position. The rocker is also moveable to a second position wherein the rocker portion clears the projection thereby allowing the slider to be moved from its locked position to its unlocked position. A spring is located between the rocker and the slider for biasing the rocker to its first position.

9 Claims, 2 Drawing Sheets

SAFETY CLASP ASSEMBLY FOR COVERED CONTAINERS

FIELD OF THE INVENTION

This invention relates to covered containers. It relates especially to a safety clasp assembly for releasably retaining a cover to a container. The safety clasp assembly is especially advantageous for use on surgical instrument sterilization trays.

BACKGROUND OF THE INVENTION

A sterilization tray usually comprises a base container with an open top for holding surgical instruments or other articles. The open top of the base container may be closed by a cover which engages over the top of the container. The cover and/or the base container may be perforated so that steam can circulate through the closed container. To prevent the cover from becoming disengaged from the base container during handling, means are usually provided for releasably securing the cover to the container.

Conventionally, the securing means consist of one or more latches which are usually mounted to one of the base container and cover and which are moveable between a locked position wherein they engage over the other of the base container and cover and an unlocked position wherein the clips are released from the other of the base container and cover. One such prior latch in widespread use consists of a rolled metal bracket hinged to an edge of the cover and a rolled metal hook member pivotally-connected to the bracket at a location thereon spaced from the bracket hinge. To lock the cover, the hook member is swung down so that the hook engages in a hole in the base container and then the bracket is swung down to a stable over center position against the cover so that tension is applied to the hook member whereupon the hook remains tightly engaged to the base container.

While that prior cover securement operates satisfactorily in many respects, it is disadvantaged in that if the closed container should be dropped onto a hard surface, the bracket may move away from its overcenter position due to inertia. Resultantly, the hook member becomes disengaged from the base container thereby allowing the cover to separate from the base container so that the contents of the container spill onto the floor. Another disadvantage is that that prior latch consists of rolled metal parts which are relatively expensive to make so that the latch cost is relatively high.

Accordingly it would be desirable to be able to provide an improved securing means for reliably releasably securing a container cover to a container base and one which is relatively easy and inexpensive to manufacture.

SUMMARY OF THE INVENTION

Accordingly it is an object of the present invention to provide a safety clasp assembly for releasably securing a container cover to a container base which will not disengage in the event the closed container is dropped onto a hard surface.

Another object of the invention is to provide a safety clasp of this type which can be moved between its locked and unlocked position easily with one hand.

Another object of the invention is to provide such a safety clasp assembly which is relatively easy and inexpensive to make and to assemble.

Still another object of the invention is to provide a safety clasp assembly to secure a container cover to a container base which is rugged and reliable, A further object is to provide such a safety clasp which is able to withstand sterilization temperatures.

Other objects will, in part, be obvious and will, in part, appear hereinafter.

The invention accordingly comprises the features of construction, combination of elements and arrangement of parts which will be exemplified in the following detailed description and the scope of the invention will be indicated in the claims.

Briefly, my safety clasp assembly for securing a cover to a container comprises a rocker, an axle pivotally connecting the rocker to the cover and a slider positioned between the axle and the cover and being slidable along the cover in a direction generally perpendicular to the axle between a locked position wherein a portion of the slider interfits with the container and an unlocked position wherein the slider portion is disengaged from the container. The slider has a projection extending away from the cover and the rocker is moveable about the axle between a first position wherein a portion of the rocker engages behind the projection when the slider is in its locked position thereby preventing the slider from moving to its unlocked position and a second position wherein the rocker portion clears the projection thereby allowing the slider to be moved from its locked position to its-unlocked position. Spring means are positioned between the rocker and the slider to bias the rocker to its first position.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
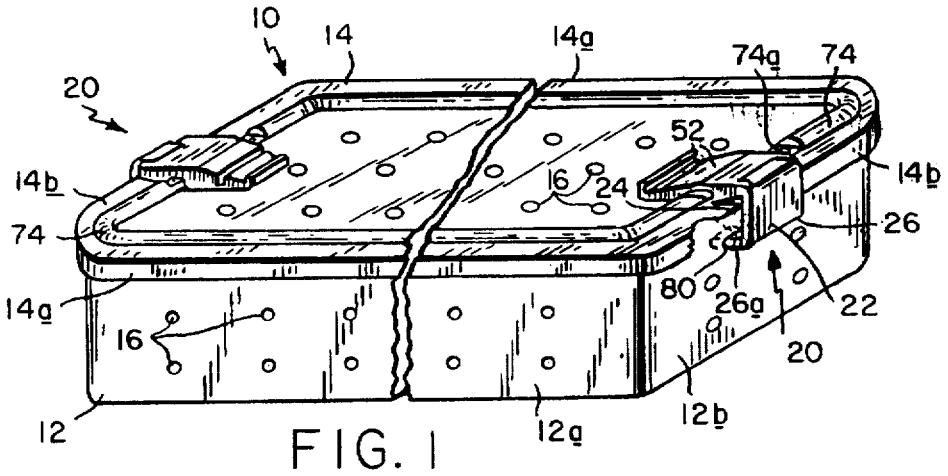
FIG. 1 is an perspective view with parts broken away of an instrument sterilization tray incorporating safety clasp assemblies according to the invention.

Refer now to FIG. 1 of the drawings which shows a generally rectangular surgical instrument sterilization tray 10. Tray 10 is composed of a relatively deep base container 12 having a pair of opposite sidewalls 12*a*, 12*a* and a pair of opposite end walls 12*b*, 12*b*. The top of the base container 12 is normally open but may be closed by a shallow cover 14 having a pair of opposite sidewalls 14*a*, 14*a* and a pair of opposite end walls 14*b*, 14*b*. When cover 14 is seated on container 12, the cover walls 14*a*, 14*b* overlap the corresponding container walls 12*a*, 12*b*. Preferably, container 12 and cover 14 are made of a strong impact resistant plastic material able to withstand sterilization temperatures. Preferably also, the cover and/or the container are formed with a multiplicity of holes 16 through which steam may circulate when instruments in tray 10 are being sterilized.

In order to releasably lock cover 14 to container 12, the tray 10 is fitted with a pair of mirror-image safety clasps shown generally at 20 situated at opposite ends of the tray. Clasps 20 lock cover 14 to container 12 during the sterilization process and during handling. However, the clasps 20 can be released easily by operating room personnel, using only one hand, when it is necessary to remove the cover 14 in order to use the sterilized instruments in container 12.

Figure 3A:
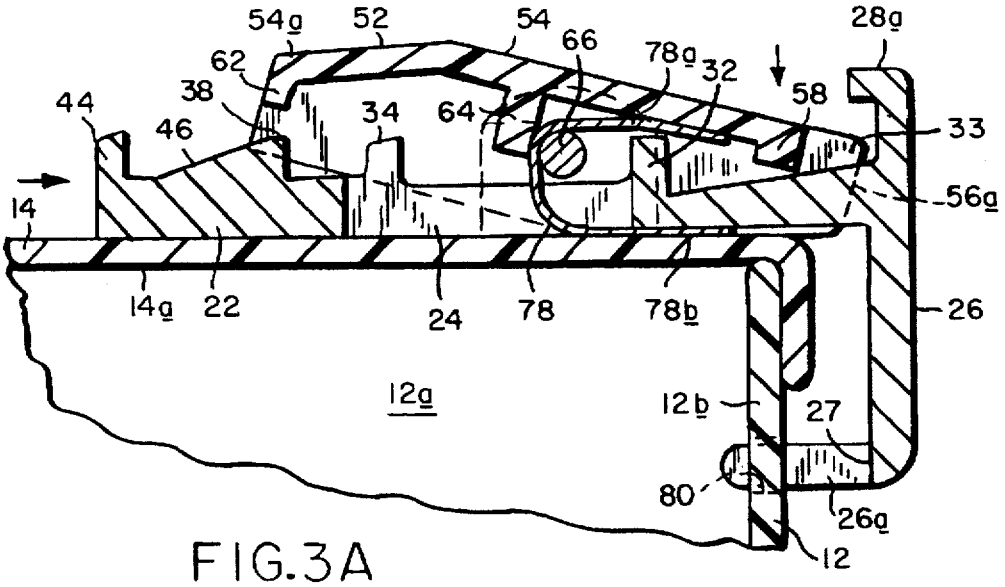
FIGS. 3A and 3B are similar views illustrating the operation of the clasp assembly.
Figure 3B:
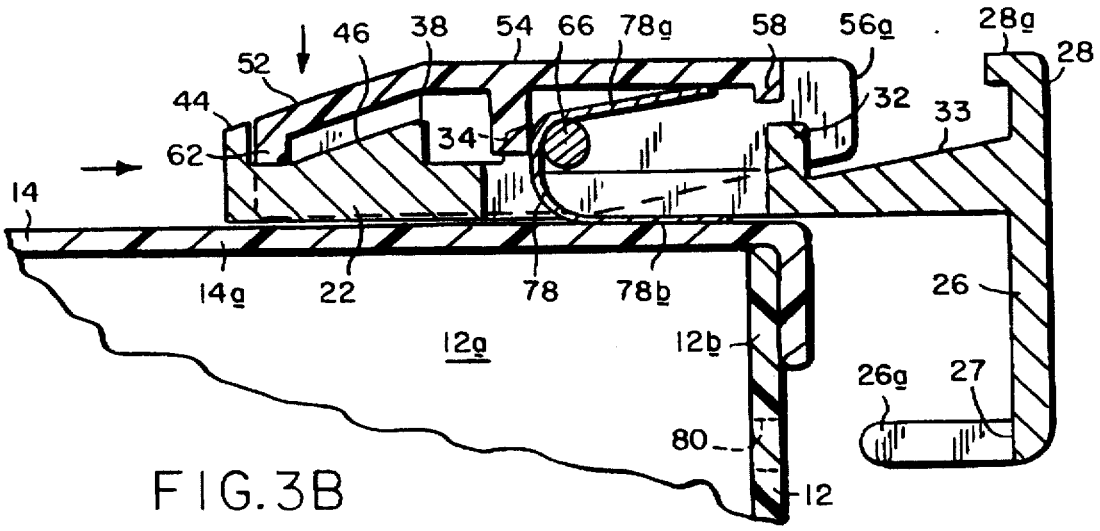
Figure 2:
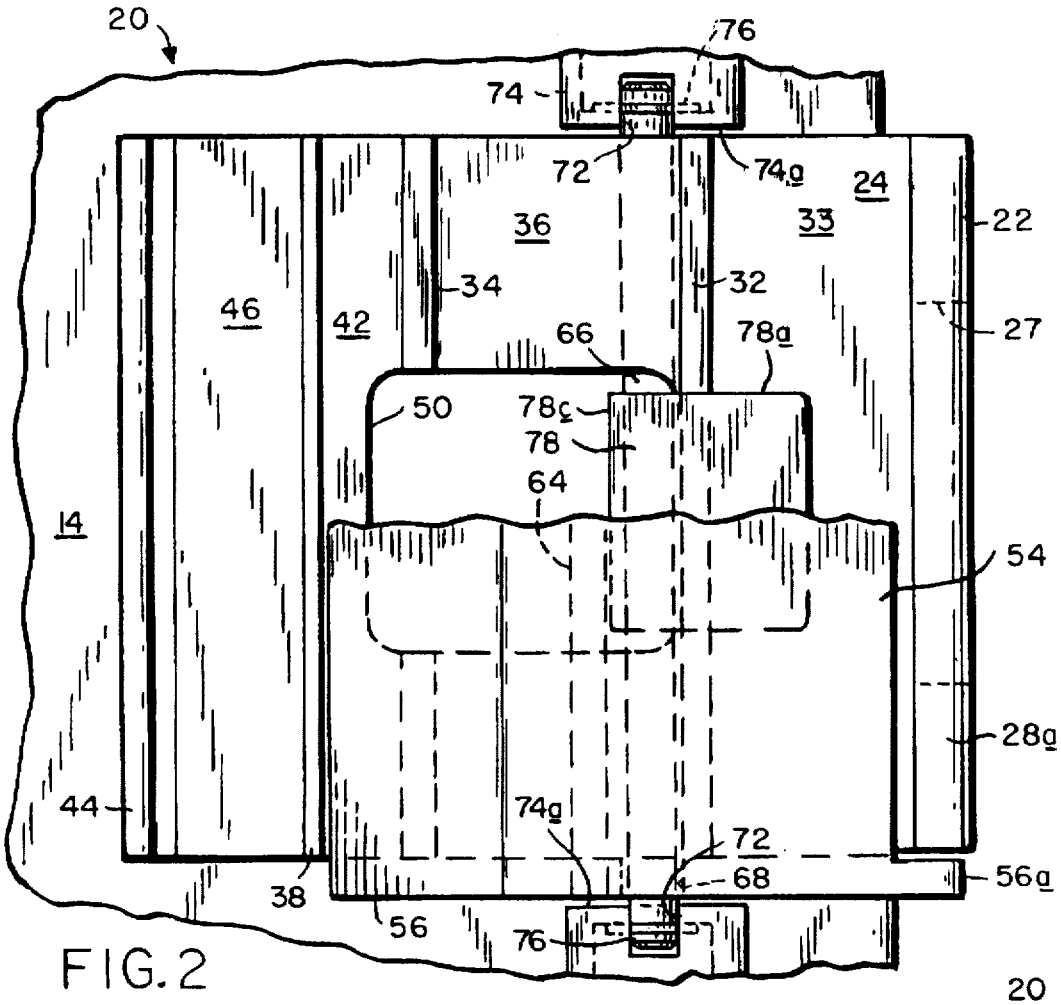
FIG. 2 is a fragmentary plan view with parts broken away on a much larger scale showing the safety clasp assembly in FIG. 1 in greater detail.
Figure 3:
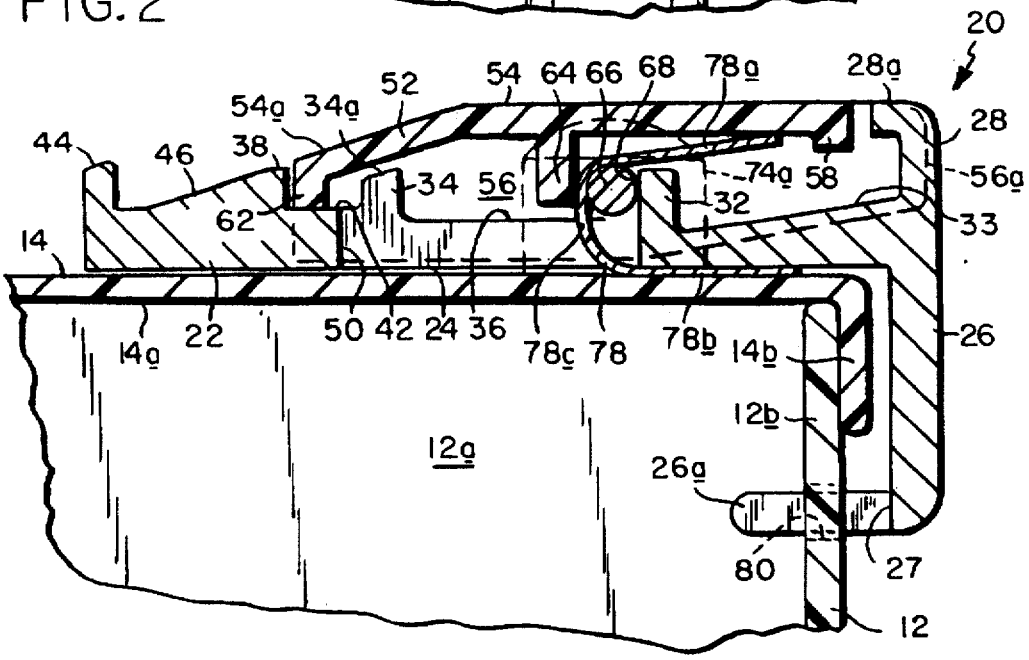
FIG. 3 is a sectional view taken along line 3—3 of FIG. 2.

Referring now to FIGS. 1 to 3, each clasp 20 is mounted to cover 14 near an end wall 14b thereof and is adapted to releasably interfit with the underlying end wall 12b of container 12 when the clasp is in its locked position and to become disengaged from that container end wall when the clasp is in its unlocked position.

More particularly, each clasp 20 comprises a slider 22 made of a suitable rigid material such as aluminum metal or a plastic able to withstand autoclave temperatures. The slider includes a flat, generally rectangular main body or plate 24 formed with an integral hook 26 which extends down from the outer end of plate 24. The hook includes a leg 26a which extends back parallel to the plate at a location spaced appreciably below the plate. Actually leg 26a may be notched as shown at 27 in FIGS. 2 and 3 so that the leg is composed of two narrow segments at opposite sides of the slider. Also formed at the same end of plate 24 is a lip 28 which extends up perpendicular to the plate. Preferably, lip 28 has an in-turned upper edge 28a which extends more or less parallel to the hook leg 26a.

Also formed along the length of the plate 24 of slider 22 is a plurality of raised transverse ribs or ridges which extend the full width of the plate and are parallel to the hook 26 and lip 28. More particularly, there is a first rib 32 spaced from lip 28 about a third of the way along the plate leaving a transverse trough 33 between lip 28 and rib 32. Spaced about two thirds of the way along plate 24 is a second rib 34 which has more or less the same height as rib 32 leaving a transverse trough 36 between the two ribs 32 and 34. Spaced from rib 34 is a third rib 38 which has more or less the same height as ribs 32 and 34 so that a relatively narrow trough 42 is formed between ribs 34 and 38. Finally, spaced from rib 38 is a fourth rib 44 which is somewhat higher than the other ribs. Also, a ramp 46 is formed between the top of rib 38 and the bottom or root of rib 44 which ramp extends the full width of slider 22.

For reasons that will become apparent, a relatively large, generally rectangular opening 50 is present in slider 22. More particularly, opening 50 is centered in the plate 24 and extends between ribs 32 and 38, thus interrupting rib 34.

The second component of clasp 20 is a rocker 52 which also may be molded of a suitable rigid metal or plastic material. Rocker 52 has a top wall 54 and a pair of opposite depending sidewalls 56, 56. The rocker is slightly wider than slider 22 so that its sidewalls 56 overlap the sidewalls of the rocker plate 24. As best seen in FIG. 3, the rocker is dimensioned to fit in the space between the slider lip 28 and the slider rib 38. Preferably, a downwardly extending transverse flange or lip 58 is provided at the outer edge of the rocker top wall 54 adjacent to lip 28. A second depending transverse flange or lip 62 is provided at the opposite or inner edge of rocker wall 54 which normally extends down into the trough 42 formed in the top of the slider 22. If desired, an inner segment 54a of the rocker top wall 54 may be inclined downwardly so that it is more or less coplanar with the slider ramp 46 enabling the rocker to nest nicely in the slider with no projecting edges. In that event, the top 34a of the slider rib 34 may be similarly angled or beveled to provide the necessary clearance for rocker segment 54a.

As best seen in FIGS. 2 and 3, desireably the sidewalls 56 of rocker 52 have extensions 56a which extend beyond the rocker top wall 54. Normally, these extensions 56a overlap the side edges of the slider lip 28 to give a nice exterior finish to the clasp. Also, a relatively long tab 64 extends down from the rocker wall 54 more or less in the middle of the rocker. When the clasp is assembled, tab 64 extends down into the slider trough 36 and projects into opening 50. The function of that tab will be described shortly.

Still referring to FIGS. 2 and 3, slider 22 and rocker 52 are movably secured together by means of a transverse axle 66 of rigid wire. With the plate 24 of slider 22 pressed flat against the top surface of cover 14 and the rocker 52 nested on top of the slider as shown in FIG. 3, axle 66 may be inserted through collinear holes 68 provided in the rocker sidewalls 56. These holes are located so that the axle extends across the slider trough 36 between rib 32 and the depending tab 64 of rocker 52. The opposite ends of axle 66 are captured in a pair of eyes 72 formed in tray cover 14 at opposite sides of clasp 20. More particularly and as shown in FIG. 1, the eyes 72 are actually holes formed in the end walls 74a of an interrupted raised ridge 74 which extends around the top of cover 14. The opposite end segments of axle 66 project through the eyes 72 and extend under rib 74 and may be held in place by friction clips or nuts 76 which may be slid onto the ends of axle 66 located under rib 64.

In order to maintain rocker 52 in its normal locking position shown in FIG. 3, a generally C-shaped leaf spring 78 is positioned between slider 22 and rocker 52 prior to their assembly. Spring 78 is located under rocker 52 between the rocker lip 58 and tab 64. The spring has an upper arm 78a which engages the underside of rocker 52, a lower arm 78b which extends through the opening 50 in slider 22 and between the slider plate 24 and the top of the tray cover 14. Connecting those two arms is a bridging portion 78c which extends down between the rocker 64 and axle 66. Spring 78 biases rocker 52 counterclockwise about axle 66 as viewed in FIG. 3 so that the rocker lip 62 is maintained in engagement with the upper surface of slider 22.

When the clasp 20 is in its locked position shown in FIGS. 2 and 3, slider 22 is positioned inwardly on the tray cover 14 so that the slider hook 26 is close enough to the corresponding end wall 12b of container 12 so that the hook leg 26a may project through a slot 80 formed in the container end wall 12b. If leg 26a is notched as described above, there would be two such slots 80 in wall 12b. This interfitting engagement of the slider with the container end wall prevents cover 14 from becoming separated from container 12.

In addition, rocker 52 is biased by spring 78 counterclockwise as viewed in FIG. 3 so that the rocker lip 62 bottoms in trough 42 of the slider, with the inner edge of the rocker positioned right next to the slider rib 38. Thus, the rocker functions as a stop that prevents the slider 22 from sliding outwardly relative to cover 14. In other words, engagement of the slider rib 38 against the inner edge and lip 62 of rocker 52 prevents slider 22 from sliding toward the right in FIG. 3 sufficiently to retract the hook leg 26a from the slot 80 in the container end wall 12b. Therefore, the clasp 20 will remain in its engaged or locked position so long as the rocker 52 is in the locking position shown in FIG. 3.

To unlock clasp 20 in order to remove cover 14, one must first rotate rocker 52 about axle 62 to its unlocking position shown in FIG. 3A by pressing down on the outer edge margin and lip 58 of the rocker, e.g., with a thumb, until the rocker lip 62 clears the top of the slider rib 38. At this point, the operator, using the same thumb, can exert an outward force on the slider lip 28 causing the slider 22 to slide outwardly along the cover 14 until the slider rib 38 underlies the rocker lip 62 as seen in FIG. 3A. At this point, the operator can release the rocker which thereupon pivots counterclockwise on axle 66 so that the rocker lip 62 engages the upper surface of the slider at ramp 46. Continued outward force on the slider lip 28 causes the slider 22 to slide outward on cover 14 sufficiently to retract the slider hook 26 from the slot 80 in the container wall 12 as shown in FIG. 3B, thereby allowing cover 14 to be removed from container 12.

The outward motion of slider 22 is stopped by the engagement of the slider rib 44 against the inner edge and lip 62 of the rocker as lip 62 follows ramp 46 to the base of rib 44. As noted above, rib 44 is higher than the other slider ribs so that even if the rocker 52 is maintained in its unlocking position shown in FIG. 3A, the rib 44 would still not clear lip 62 so that there is a definite limit to the outward sliding motion of the slider 22. A backup outer motion stop is provided by the engagement of the slider rib 34 with axle 66 as shown in FIG. 3B. The inward locking motion of the slider, on the other hand, is stopped by the engagement of the slider rib 32 against axle 66 as shown in FIG. 3.

It should be noted that when slider 22 moves between its locked and unlocked positions shown in FIGS. 3 and 3B, the opening 50 in the slider provides clearance for rocker tab 64. The tab is only slightly narrower than the opening 50 so that it helps to guide the slider and confines the slider to movements perpendicular to axle 66.

It will thus be seen that the objects set forth above, among those made apparent from the preceding description, are efficiently attained. Also, certain changes may be made in the above construction without departing from the scope of the invention. For example, the hook 26 could just as well engage under a protuberance on the container end wall 12*a*. Also, instead of the rocker and slider interfitting with mutual projections or ribs to establish the locked and unlocked positions of the slider, the slider or the rocker may have projections which engage in recesses or holes in the opposite member to lock the slider. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A safety clasp assembly for locking a cover to a container, said assembly comprising a rocker;

an axle pivotally connecting the rocker to the cover;

a slider positioned between the axle and the cover and being slidable along the cover in a direction generally perpendicular to said axle between a locked position wherein a portion of the slider interfits with the container and an unlocked position wherein the slider portion is disengaged from the container, said slider having an edge extending away from the cover and said rocker being moveable about said axle between a first position wherein a portion of the rocker engages said edge when said slider is in its locked position thereby preventing the slider from moving to its unlocked position and a second position wherein the rocker portion clears said edge thereby allowing the slider to be moved from its locked position to its unlocked position, and spring means positioned between the rocker and the slider for biasing the rocker to its said first position.

2. The safety clasp assembly defined in claim 1 wherein the slider has a projection extending away from the cover said projection being spaced from said edge and being engaged by said slider portion when the slider is moved to its unlocked position.

3. The safety clasp assembly defined in claim 1 and further including stop means for establishing the locked and unlocked positions of the slider.

4. The safety clasp assembly defined in claim 1 and further including an opening in said slider, and a tab extending from said rocker into said opening.

5. The safety clasp assembly defined in claim 4 wherein said spring means comprise a generally C-shaped leaf spring having one arm which engages said rocker and a second arm which extends through said opening and between said slider and said cover.

6. The safety clasp assembly defined in claim 1 wherein said slider portion comprises a hook.

7. A safety clasp assembly comprising an open top container having a wall;

a cover for closing the top of said container;

an axle;

means for mounting said axle to said cover;

a rocker mounted to said axle;

a slider positioned between the axle and the cover and being slidable along the cover in a direction generally perpendicular to said axle between a locked position wherein a portion of the slider interfits with the container and an unlocked position wherein the slider portion is disengaged from the container, said slider having an edge extending away from the cover and said rocker being moveable about said axle between a first position wherein a portion of the rocker engages said edge when said slider is in its locked position thereby preventing the slider from moving to its unlocked position and a second position wherein the rocker portion clears said edge thereby allowing the slider to be moved from its locked position to its unlocked position, and spring means positioned between the rocker and the slider for biasing the rocker to its said first position.

8. A safety clasp assembly defined in claim 7 wherein said container has an opening in its said wall, and said slider portion comprises a hook which hooks into said opening when the slider is in its locked position.

9. The safety clasp assembly defined in claim 8 wherein said mounting means comprise a ridge formed in said cover, and said axle extends through a wall of said ridge.

* * * * *